US006533456B1

(12) United States Patent
Buchman

(10) Patent No.: US 6,533,456 B1
(45) Date of Patent: Mar. 18, 2003

(54) RECLOSABLE STAND-UP PACKAGE, AND METHODS

(75) Inventor: James E. Buchman, Hortonville, WI (US)

(73) Assignee: Reynolds Consumer Products, Inc., Appleton, WI (US)

( * ) Notice: Subject to any disclaimer, the term of this patent is extended or adjusted under 35 U.S.C. 154(b) by 0 days.

(21) Appl. No.: 09/966,647

(22) Filed: Oct. 1, 2001

(51) Int. Cl.[7] ..... B65D 33/16
(52) U.S. Cl. ..... 383/63; 383/120
(58) Field of Search ..... 383/63, 64, 120

(56) References Cited

U.S. PATENT DOCUMENTS

| | | | | |
|---|---|---|---|---|
| 4,332,344 | A | 6/1982 | Strodthoff | |
| 4,706,297 | A | 11/1987 | Ausnit | |
| 4,736,450 | A | 4/1988 | Van Erden et al. | |
| 5,037,138 | A | 8/1991 | McClintock et al. | |
| 5,080,253 | A | 1/1992 | Zieke | |
| 5,174,445 | A | 12/1992 | Mull | |
| 5,275,491 | A | 1/1994 | Kuge et al. | |
| 5,364,189 | A | 11/1994 | Kuge et al. | |
| 5,622,431 | A | 4/1997 | Simonsen | |
| 5,692,837 | A | 12/1997 | Beer | |
| 5,788,378 | A | 8/1998 | Thomas | |
| 6,030,123 | A | 2/2000 | Mitarai | |
| 6,164,821 | A * | 12/2000 | Randall | 150/120 |
| 6,164,826 | A * | 12/2000 | Petkovsek | 383/120 |
| 6,186,663 | B1 * | 2/2001 | Ausnit | 24/30.5 R |
| 6,213,645 | B1 * | 4/2001 | Beer | 383/103 |
| 6,296,388 | B1 * | 10/2001 | Galomb et al. | 222/478 |
| 6,325,543 | B1 * | 12/2001 | Ausnit | 383/120 |
| 6,341,688 | B1 * | 1/2002 | Graham | 134/201 |

FOREIGN PATENT DOCUMENTS

| | | |
|---|---|---|
| CA | 2211758 | 2/1998 |
| JP | 4006049 | 1/1992 |
| JP | 5147663 | 6/1993 |

* cited by examiner

*Primary Examiner*—Jes F. Pascua
(74) *Attorney, Agent, or Firm*—Julie R. Daulton; Tracey D. Beiriger

(57) ABSTRACT

Stand-up, gusseted packages having a reclosable closure mechanism around the periphery of the package mouth. The package has opposite first and second panels, and first and second side panels, which together form a surrounding wall that defines the mouth. The closure mechanism is present on each of the panels. On the first and second panels, the closure mechanism is oriented inward, so that the panels can be interlocked. On each of the first and second side panels, the closure mechanism is oriented outward, and is present as a first portion and a second portion defined by the gusset. To close the package, the closure mechanisms on the first panel and second panel are interlocked, and the side panels are folded inward to allow the first portion and the second portion to interlock. Methods of making the package are described.

20 Claims, 8 Drawing Sheets

RECLOSABLE STAND-UP PACKAGE, AND METHODS

TECHNICAL FIELD

This disclosure generally relates to resealable packages having a reclosable zipper closure. More particularly, this disclosure relates to gusseted stand-up packages.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

One type of reclosable package, the reclosable bag, typically includes first and second opposing panels of a flexible material such as plastic film or paper. For example, the first and second opposing panels may be formed from a single sheet of film folded or wrapped upon itself. The sides of the opposing panels are fixedly connected to each other by heat sealing or by other means. The bottom is sealed closed. The top edges of the panels define a mouth opening which permits access to the contents of the bag. The reclosable package is equipped with reclosable fasteners positioned at the package mouth and extending inwardly across the mouth. Examples of reclosable fasteners include extruded fastener profiles such as complementary rib and groove fastener profiles or male and female fastener profiles.

Improvements in the design of stand-up packages are desirable.

SUMMARY OF THE DISCLOSURE

The present disclosure is directed to a stand-up, gusseted package having a reclosable closure mechanism around the periphery of the package mouth. The package has opposite first and second panels, and first and second side panels, which together form a surrounding wall that defines the mouth. The closure mechanism is present on each of these panels. On the first and second panels, the closure mechanism is oriented inwardly, so that the panels can be interlocked. On each of the first and second side panels, the closure mechanism is oriented outwardly, and is present as a first portion and a second portion defined by the gusset. To close the package, the closure mechanisms on the first panel and second panel are interlocked, and the side panels are folded inwardly to allow the first portion and the second portion to interlock.

In one particular embodiment, a flexible package is provided. The package comprises a first panel, an opposite second panel, a first side panel and an opposite second side panel, together defining a package surrounding wall. The first side panel includes a fold line dividing the first side panel into a first portion and a second portion, and the second side panel includes a fold line dividing the second side panel into a first portion and a second portion. The package further has a bottom attached to each of the first panel, second panel, first side panel and second side panel, the bottom together with surrounding wall defining an interior for retaining an item therein. At the other end, a mouth defined by surrounding wall opposite the bottom provides access to the package interior. A reclosable closure mechanism surrounds the mouth, the reclosable closure mechanism comprising a first interlocking closure profile and a second interlocking closure profile. The reclosable closure mechanism comprises a panel extension of closure mechanism comprising the first interlocking closure profile operably oriented on the first panel and the second interlocking closure profile operably oriented on the second panel, so that the first interlocking closure profile is engageable with the second interlocking closure profile. The reclosable closure mechanism also comprises a first gusset extension of closure mechanism comprising the first interlocking closure profile attached to the first portion of the first side panel, and the second interlocking closure profile attached to the second portion of the first side panel, so that the first interlocking closure profile is engageable with the second interlocking closure profile. Yet further, the reclosable closure mechanism comprises a second gusset extension of closure mechanism comprising the first interlocking closure profile attached to the first portion of the second side panel, and the second interlocking closure profile attached to the second portion of the second side panel, so that the first interlocking closure profile is engageable with the second interlocking closure profile.

In a variation, the reclosable closure mechanism comprises a panel extension of closure mechanism comprising the first interlocking closure profile operably oriented on the first panel and the second interlocking closure profile operably oriented on the second panel, so that the first interlocking closure profile is engageable with the second interlocking closure profile; a first gusset extension of closure mechanism comprising the first interlocking closure profile attached to the first portion of the first side panel, and the second interlocking closure profile attached to the second portion of the first side panel, so that the first interlocking closure profile is engageable with the second interlocking closure profile; and a second gusset extension of closure mechanism comprising the first interlocking closure profile attached to the first portion of the second side panel, and the second interlocking closure profile attached to the second portion of the second side panel, so that the first interlocking closure profile is engageable with the second interlocking closure profile.

Methods of making the packages are also described.

DETAILED DESCRIPTION

Figure 1:
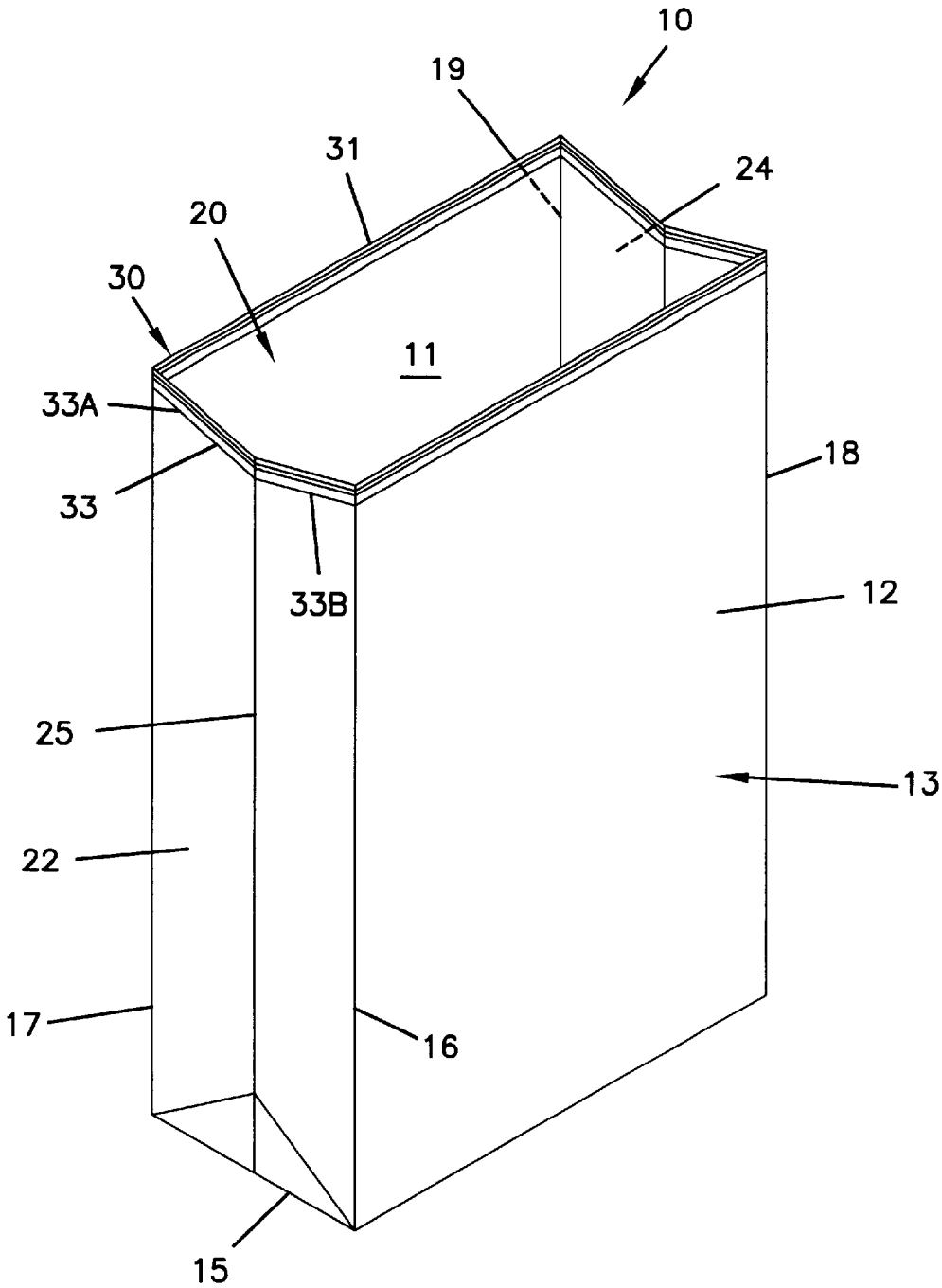
FIG. 1 is a perspective, schematic view of a first embodiment of a resealable, reclosable stand-up package constructed according to principles of this disclosure.
Figure 2:
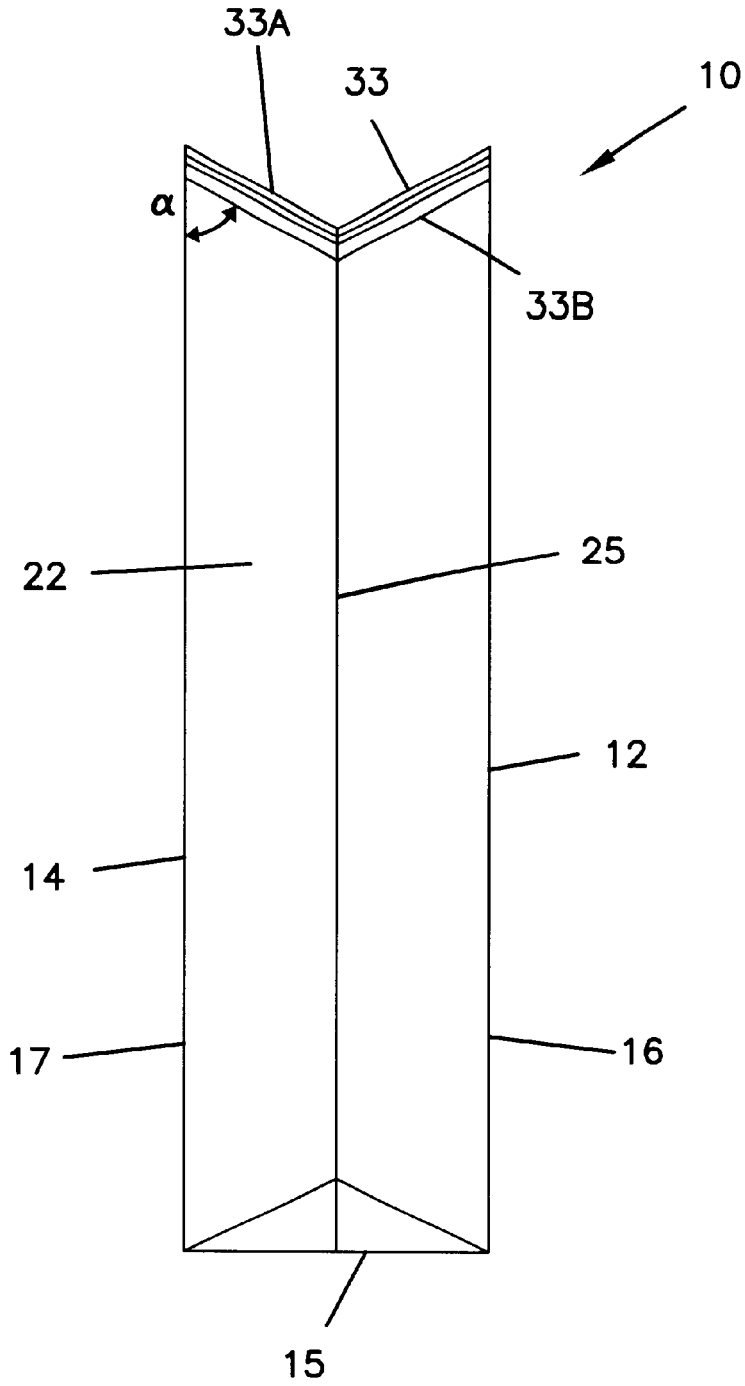
FIG. 2 is a side elevational view of the stand-up package of FIG. 1.

Attention is directed to FIGS. 1 and 2, which illustrate an example packaging arrangement in the form of a resealable, reclosable, stand-up package 10. Generally, package 10 is a flexible package, made from, for example, polymeric material such as polyethylene, polypropylene, or other plastics, paper, metal or foil, or any combinations thereof. Package 10 is considered a "stand-up package", for reasons which will be described below.

Package 10 has an interior containment section 11 defined by first panel 12, second panel 14 that is positioned opposite first panel 12, first side panel 22, and second side panel 24 that is positioned opposite first side panel 22. Side panels 22, 24 are foldably connected to panels 12, 14; specifically, first side panel 22 is foldably connected to first panel 12 at an edge 16 and to second panel 14 at an edge 17, and second side panel 24 is foldably connected to first panel 12 at an edge 18 and to second panel 14 at an edge 19. In the embodiment shown, panels 12, 14, 22, 24 are rectangular in shape, although many different shapes and sizes of panels may be used depending on the desired application. Together with bottom 15, these panels 12, 14, 22, 24 form a surrounding wall 13 that retains items within interior 11. Access is gained to interior 11 through mouth 20. Mouth 20 is defined by panels 12, 14, 22, 24 and preferably, mouth 20 is the same size and shape as bottom panel 15. In some embodiments, however, it may be desired to have mouth 20 smaller or larger than bottom panel 15. This can be accomplished, for example, by having panels that taper smaller or larger, respectively, as the panels extend from bottom panel 15 to mouth 20. It is understood that a flexible package 10 can be easily distorted so that mouth 20 may not have the same shape as bottom panel 15.

Surrounding wall 13, that is, panels 12, 14, 22, 24, can be formed in many ways. Typically, surrounding wall 13 is manufactured from a single piece of web material, such as plastic. A seam, such as a heat seal, may be present at one or multiple edges where the various panels meet. For example, edge 16 between and connecting first panel 12 and first side panel 22 may be a seam. Alternately, a seam may be present within a panel, such as first panel 12. In yet an alternate embodiment, surrounding wall 13 can be formed from a seamless, tubular material. In preferred embodiments, bottom 15 is generally a flat, planar panel and may or may not include a seam therein.

Side panels 22, 24 of package 10 are gussets, which are known for providing packages with "stand-up" features. Gussets also allow full extension of package 10, so as to achieve a large opening at mouth 20, and also allow convenient folding or collapsing of package 10 when not in use. Typically when making gussets, a single piece of film is folded to form the gusseted panel section, such as side panel 22. Gusseted panels include a gusset fold 25, which facilitates folding of side panels 22, 24 and package 10.

To allow package 10 to be resealed after its initial opening, package 10 further includes a reclosable closure mechanism 30 at mouth 20. Closure mechanism 30 can be any one of a variety of closure mechanisms that have interlockable or otherwise engageable first and second profiles. Typically, closure mechanism 30 is a zipper-type closure mechanism. By the term "zipper-type closure mechanism," it is meant a structure having opposite interlocking or mating profiled elements that under the application of pressure will interlock and close the region between the profiles.

Examples of common reclosable closure mechanisms 30 include those having male and female type profiles or two other engageable profiles. The profiles may be self-mating, meaning that the same profile is used for each of the two mating profiles; in some embodiments, it may be preferred to use self-mating profiles. Typically, the resealable closure mechanism 30 is made of conventional materials, such as a polymeric, plastic material, for example, polyethylene, polypropylene, or PVC. One example of a usable reclosable closure mechanism 30 is shown in FIG. 5.

Figure 5:
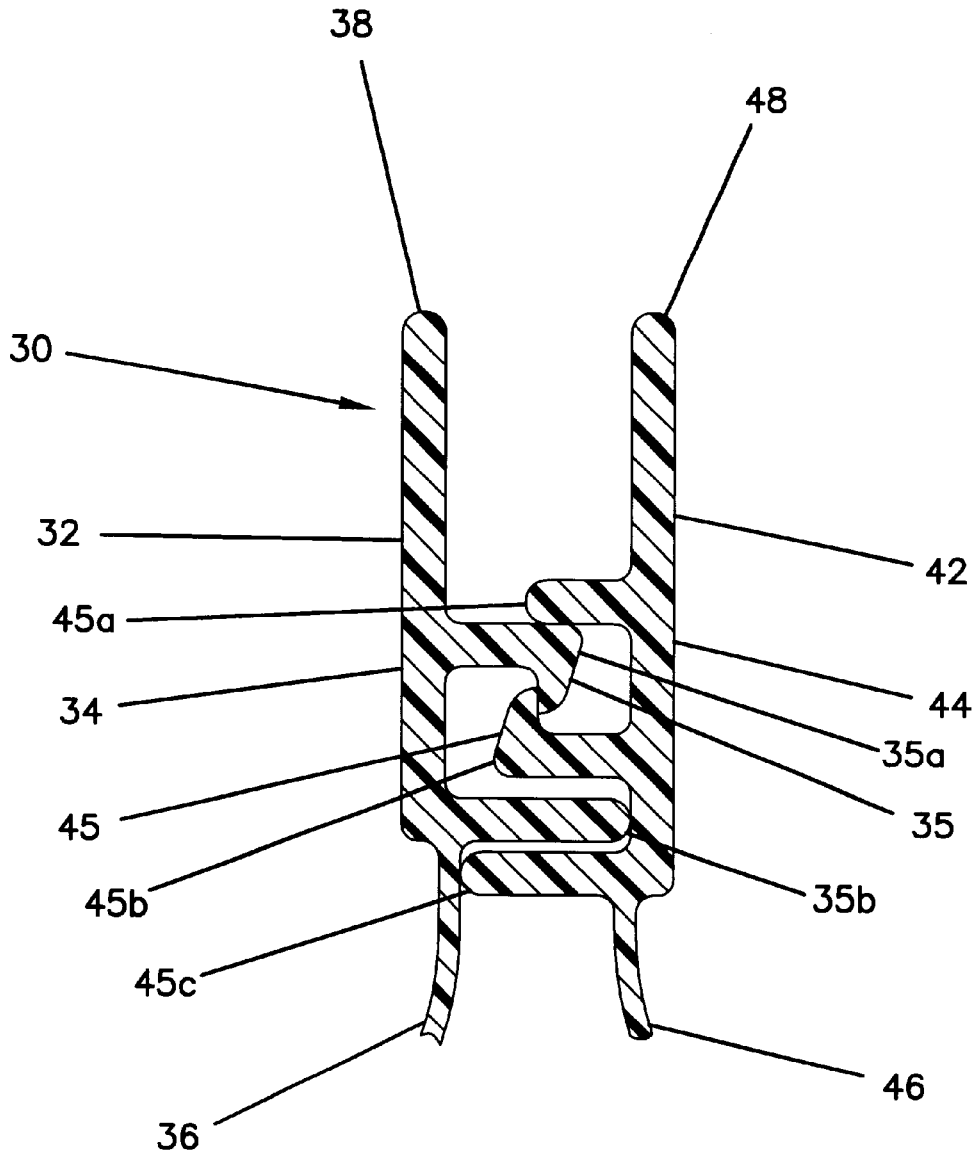
FIG. 5 is an enlarged, schematic cross-sectional view of a reclosable closure mechanism suitable for incorporation into the stand-up packages of the previous figures.

Closure mechanism 30 of FIG. 5 has a first closure profile 32 and a second closure profile 42, which interlock. First closure profile 32 includes a base strip 34, a sealing flange or bonding strip 36, a first mating closure member 35, and an upper flange or distal end 38. Mating closure member 35 extends from base strip 34 and generally projects from base strip 34. Sealing flange 36 depends or extends downward from base strip. 34 and has sufficient structure so that it can be attached to a panel section, such as first panel section 12 of the package 10 shown in FIGS. 1 and 2.

Second closure profile 42 is similar to first closure profile 32 in that it includes a base strip 44, a bonding strip or sealing flange 46, a second mating closure member 45, and an upper flange or distal end 48. Mating closure member 45 extends from base strip 44 and is generally projecting from base strip 44. Mating closure member 45, as shown in FIG. 5, has three members 45*a*, 45*b*, 45*c* projecting from base strip 44, whereas mating closure member 35 of first closure profile 32 has two members 35*a*, 35*b* projecting from base strip 34. Sealing flange 46 depends or extends downward from base strip 44 and can be attached to a second panel section, such as second panel section 14 of package 10 shown in FIGS. 1 and 2.

First and second closure profiles 32, 42 are designed to engage with one another; in particular, first and second mating closure members 35, 45 are designed to mate and engage with one another. Pressure is applied to closure profiles 32, 42 as they engage to form the openable sealed closure mechanism 30. Pulling or otherwise prying first closure profile 32 and second closure profile 42 away from each other causes the two closure profiles 32, 42 to disengage, opening package 10 of FIGS. 1 and 2. This provides access to the contents of package 10 through mouth 20.

Referring again to FIGS. 1 and 2, closure mechanism 30 is present at mouth 20 at each of panels 12, 14, 22, 24. Specifically, closure mechanism 30 has a panel extension 31, present on first and second panels 12, 14, and a gusset extension 33, present on side panels 22, 24. Panel extension 31 is operably secured to or present on first and second panels 12, 14 so that first and second mating closure members 35, 45 of first and second mating closure profiles 32, 42 (FIG. 5) are positioned facing towards each other. That is, panel extension 31 is positioned on first and second panels 12, 14 so that the two profiles of panel extension 31 can interlock or otherwise engage. When panel 12 and panel 14 are brought together and contact each other at mouth 20, panel extension 31 can be interlocked to form a seal across mouth 20.

Gusset extension 33 is operably secured to or present on first and second side panels 22, 24 so that first and second mating closure members 35, 45 extend outwardly away from interior 11 of package 10. Gusset extension 33 is present as a first portion 33*a* and a second portion 33*b*, which are defined by or separated by gusset fold 25, so that first portion 33*a* is present between gusset fold 25 and panel 14 and second portion 33*b* is present between gusset fold 25 and panel 12. The closure mechanisms of first portion 33*a* and second portion 33*b* are oriented so that first portion 33*a* is interlockable or otherwise engageable with the closure mechanism of second portion 33*b*. This arrangement is provided so that when package 10 is collapsed, side panels 22, 24 fold at gusset 25, and first portion 33*a* and second portion 33*b* are brought together and contact each other.

In package 10, best seen in FIG. 2, gusset extension 33 is not level or aligned with panel extension 31. Rather, the majority of gusset extension 33 is positioned below, or closer to bottom 15 than, panel extension 31. This allows panel extension 31 to be interlocked or sealed without interference from gusset extension 33 on side panels 22, 24. Additionally, this allows gusset extension 33 to be interlocked without. interference from panel extension 31. Gusset extension 31 slopes or angles toward bottom 15 as it nears gusset fold 25. The angle at which gusset extension 33 is present, that is, the angle formed between side edges 16, 17 of side panel 22 and gusset extension 33, is shown as angle a in FIG. 2. Angle $\alpha$ is typically greater than 20 degrees and less than 80 degrees. Preferably, this angle is about 50 to 70 degrees, and most preferably about 60 degrees.

Figure 3:
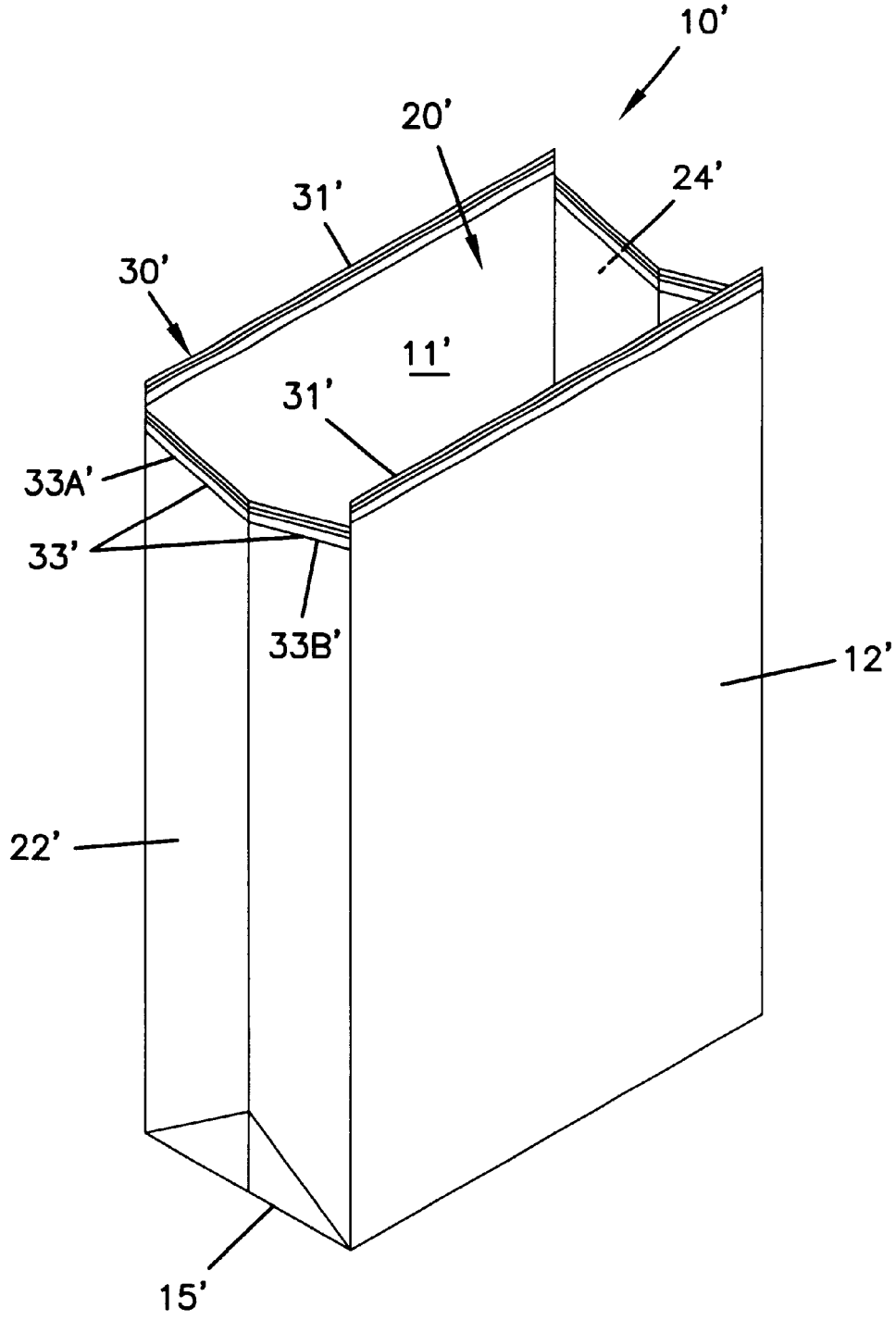
FIG. 3 is a perspective, schematic view of a second embodiment of a resealable, reclosable stand-up package constructed according to principles of this disclosure.
Figure 4:
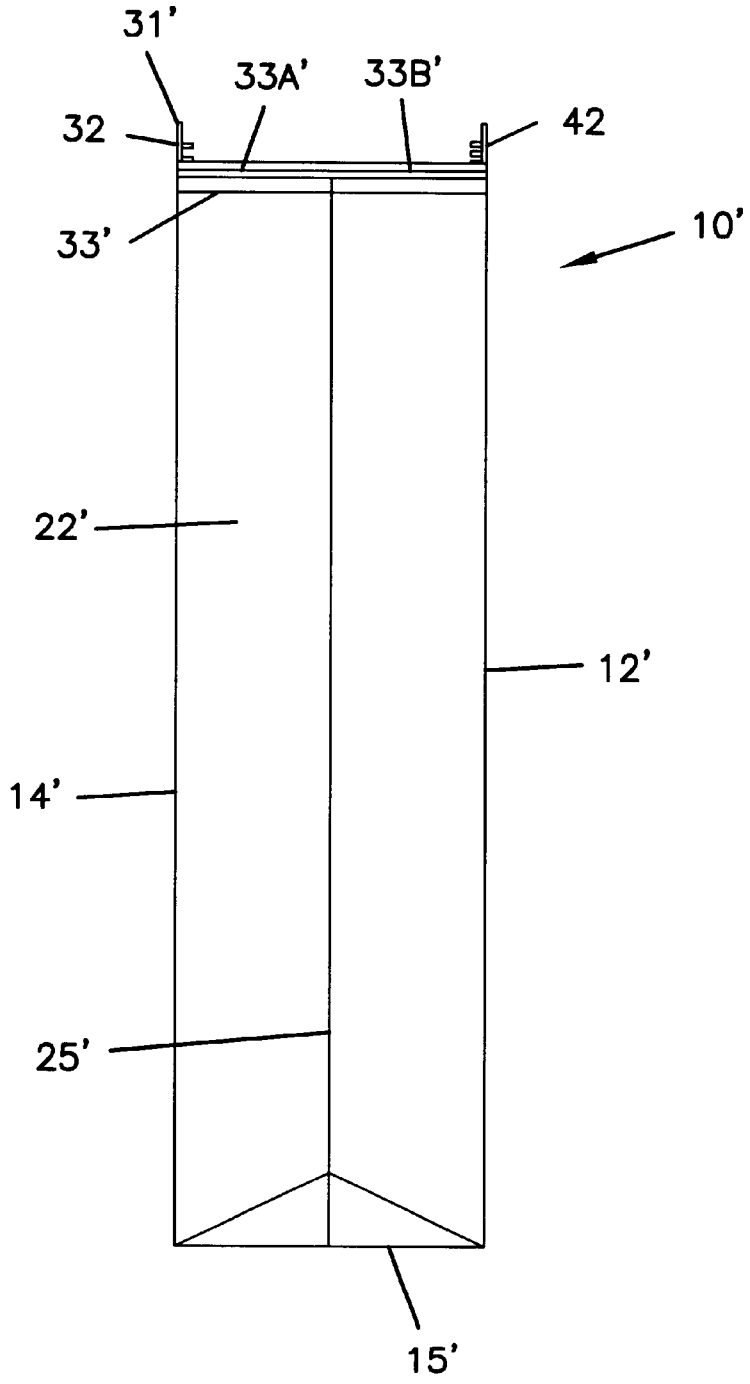
FIG. 4 is a side elevational view of the stand-up package of FIG. 3.

An alternate embodiment of a package 10' is shown in FIGS. 3 and 4. For ease of identification, those elements in the embodiment of FIGS. 3 and 4 that are the same or which perform the same function as comparable elements previously discussed with respect to package 10 of FIGS. 1 and 2 are followed by a prime designation (i.e., "'"). Package 10' is similar to package 10 of FIGS. 1 and 2 in that package 10' has a surrounding wall formed by opposite panels 12', 14', side panels 22', 24' and bottom 15' that define interior 11'. Mouth 20' is surrounded by reclosable closure mechanism 30'. Gusset 25' in side panels 22', 24' provides package 10' with stand-up features and allows expansion of mouth 20'.

Closure mechanism 30' has a panel extension of closure mechanism, 31', present on first and second panels 12', 14', and a gusset extension of closure mechanism 33', present on side panels 22', 24'. Gusset extension 33' is present as first portion 33*a*' and second portion 33*b*', which are defined by the fold of gusset 25', so that first portion 33*a*' is present between gusset 25' and panel 14' and second portion 33*b*' is present between gusset 25' and panel 12'. The closure mechanisms of first portion 33*a*' and second portion 33*b*' are oriented so that first portion 33*a*' is interlockable or otherwise engageable with the closure mechanism of second portion 33*b*' when gusset 25' is folded.

In package 10', best seen in FIG. 4, gusset extension 33 on side panels 22', 24' is not level with panel extension 31'; rather, gusset extension 33' is positioned below panel extension 31'; that is, gusset extension 33' is closer to bottom 15' than panel extension 31'. This allows panel extension 31' to be sealed without interference from gusset extension 33'. The displacement or offset of gusset extension of closure mechanism 33' from panel extension 31' should be sufficient so that panel extension 31' does not interfere with sealing of gusset extension 33', and vice versa. This displacement is typically at least 4 mm and typically no greater than 25 mm. In many embodiments, the displacement or offset of gusset extension of closure mechanism 33' from panel extension 31' is at least 5 mm and no greater than 20 mm. Preferably, gusset extension 33' is positioned about 8 mm below panel extension 31'. Gusset extension 33' should not be spaced so far from panel extension 31'that leaking out of any items within interior 11' of package 10' would occur. Although spaced from panel extension 31', gusset extension 33' is parallel to major length 31'.

Reclosable closure mechanism 30, 30' is present around all sides of mouth 20, 20' so that package 10, 10' can be securely sealed when desired. Stand-up packages having a reclosable closure mechanism on only two opposite sides have been known, but these designs have a tendency to allow items to pass through.

Although only two variations for offsetting gusset extension 33, 33' from panel extension 31, 31', it is foreseen that other embodiments may also exist.

Preferably each profile of panel extension 31, 31' extends completely across the width of panels 12, 12', 14, 14'; that is, each profile of panel extension 31, 31' preferably extends from first side panel 22, 22' to second side panel 24, 24'. Similarly, preferably each profile of gusset extension 33, 33' extends completely across the width of side panels 22, 22', 24, 24'; that is, each profile of gusset extension 33, 33' preferably extends from first panel 12, 12' to second panel 14, 14'.

Preferably, there are no interruptions in either panel extension 31, 31' or gusset extension o 33, 33'; each extension of closure mechanism 31, 33 is continuous and contiguous. The corners or seams at which panel extension of closure mechanism 31, 31' meets gusset extension of closure mechanism 33, 33', are preferably sturdy and secure seals, with no gaps or unsealed area therebetween, so that mouth 20, 20' continuously and contiguously surrounded by reclosable closure mechanism 30, 30'; however, it is understood that in some embodiments a gap or other non-continuous element may be present.

Other embodiments of packages in accordance with the present invention are also foreseen. For example, the package can be formed from any number of panels more than three.

Package 10, 10' can be made by a variety of technique. Packages 10, 10' will be made to include reclosable closure mechanism 30, 30' present along the entire periphery or circumference of mouth 20, 20'.

Figure 6:
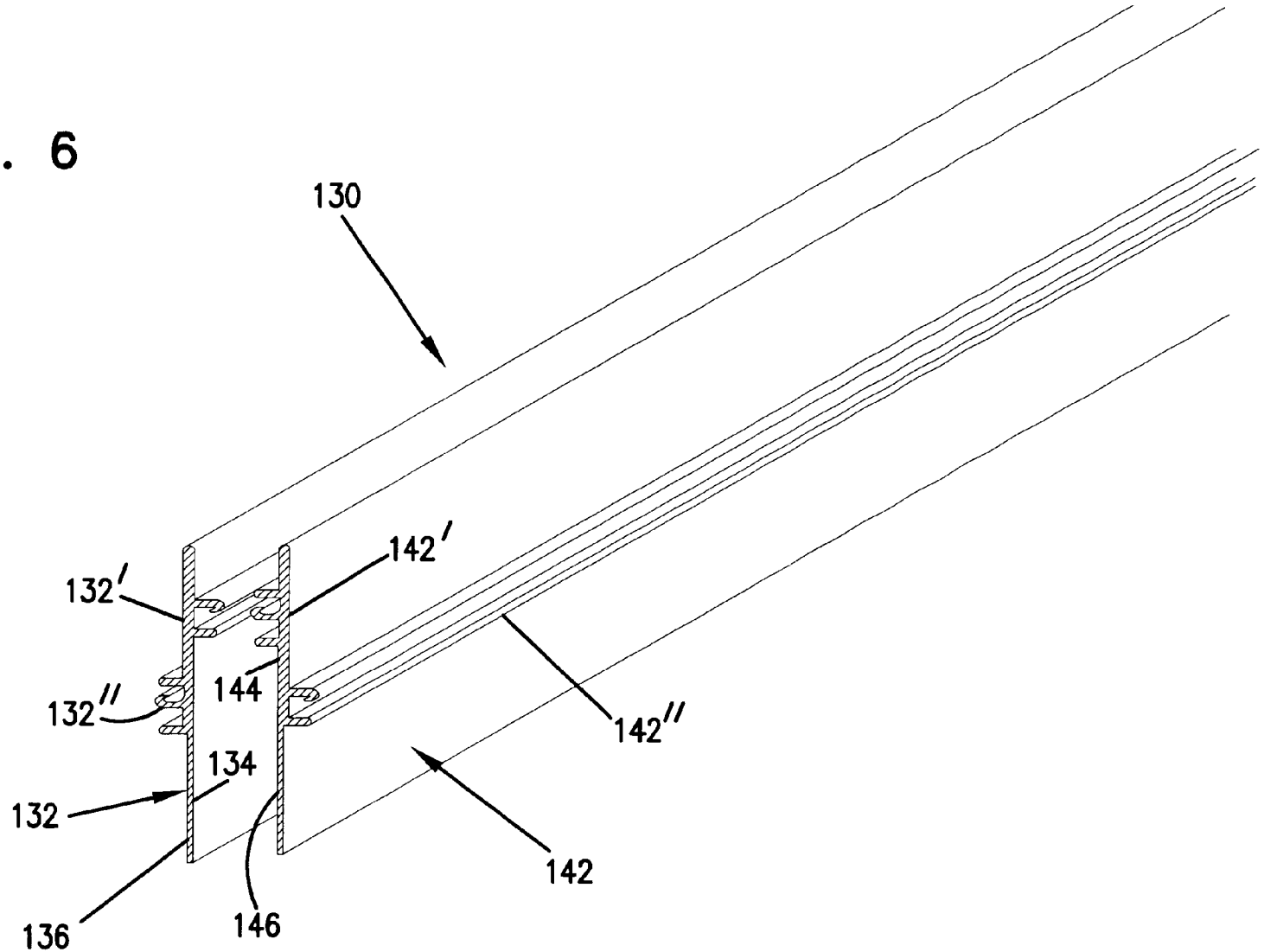
FIG. 6 is an enlarged, schematic perspective view of a second reclosable closure mechanism suitable for incorporation into the stand-up packages of FIGS. 1 through 4.

Referring to FIG. 6, a reclosable closure mechanism 130 is shown that can be incorporated into a package, such as package 110 of FIG. 7, according to the present invention by the manufacturing method described below. Reclosable closure mechanism 130 has a first closure profile 132 and a second closure profile 142, which interlock. Reclosable closure mechanism 130 differs from closure mechanism 30 of FIG. 5 in that each of first and second closure profile 132, 142 has an inner closure profile 132', 142' and an outer closure profile 132", 142". That is, first closure profile 132 has inner closure profile 132' and outer closure profile 132" extending in opposite directions from a base strip 134. Extending or depending from base strip 134 is a sealing flange 136 that can be attached to a panel section, such as first panel section 12 of package 10 shown in FIGS. 1 and 2. Similarly, second closure profile 142 has inner closure profile 142' and outer closure profile 142" extending in opposite directions from a base strip 144. Second closure profile 142 has a sealing flange 146 extending or depending from base strip 144. By use of the terms "inner" and "outer" closure profile, it is intended to signify the orientation of the closure profiles upon being incorporated into a package, such as package 10, 10'. Inner closure profiles 132', 142' interlock or otherwise mate or engage with each other, as do outer closure profiles 132", 142".

Figure 7:
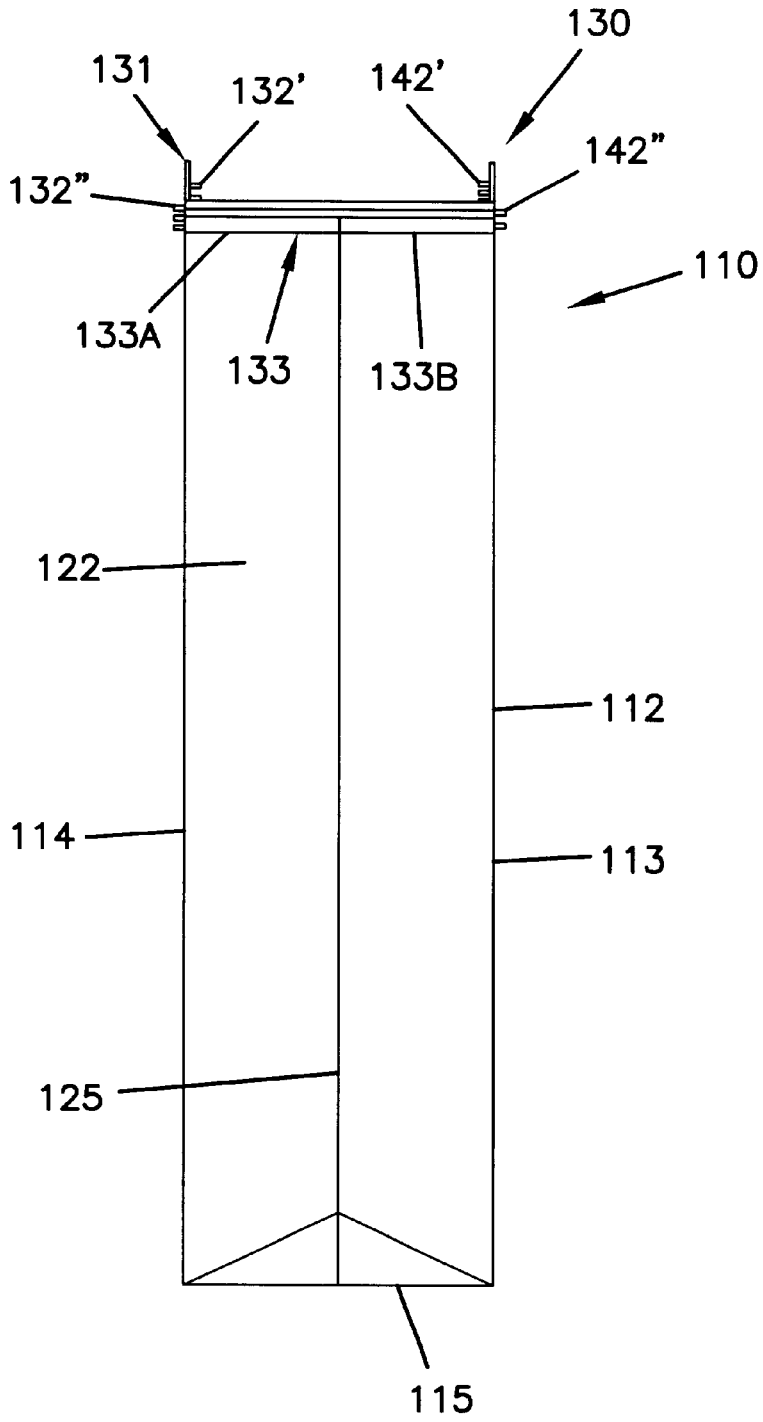
FIG. 7 is a side elevational view of a stand-up package incorporating the reclosable closure mechanism of FIG. 6.

A package incorporating reclosable closure mechanism 130 is shown in FIG. 7 as package 110. Package 110 has a surrounding wall 113 formed by opposite panels 112 114, side panels 122, 124 and bottom 115. Side panels 122, 124 are gusseted to provide package 110 with stand-up features; to facilitate folding of package 110, gusset fold 125 is included. Package 110 has reclosable closure mechanism 130 present at mouth 120, at the end opposite bottom 115.

Closure mechanism 130 is present as a panel extension 131 on each of panels 112, 114; specifically, inner profile 132' and outer profile 132" are operably present on panel 114 and inner profile 142' and outer profile 142" are operably present on panel 112. Inner profiles 132', 142' extend inward toward each other and are positioned to be interlocked. Also present is gusset extension 133, which is present as a first portion 133*a* and a second portion 133*b*, separated by gusset fold 125, on side panel 122 and also on the opposite side panel, not shown in FIG. 7.

Figure 8:
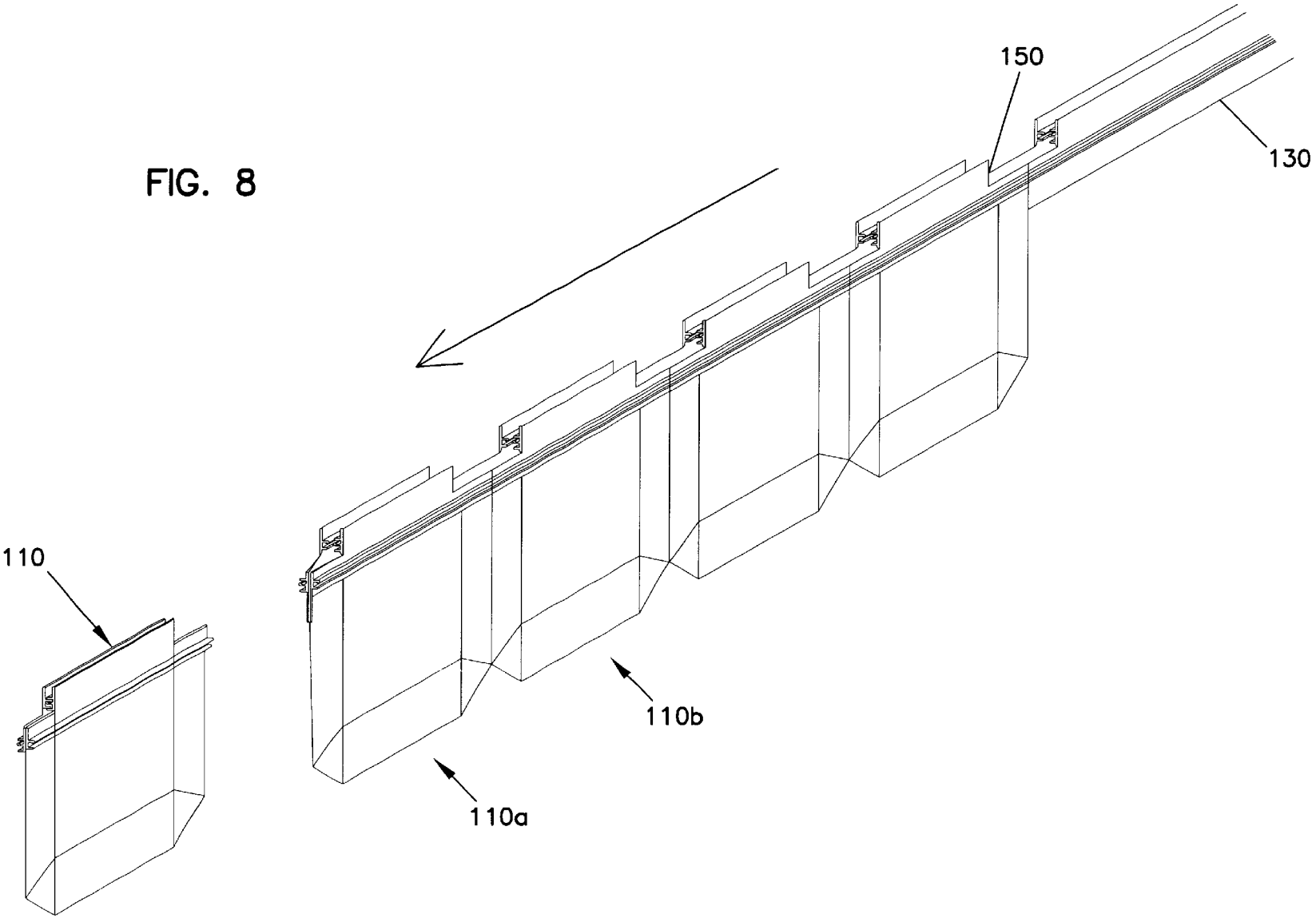
FIG. 8 is a schematic depiction of a process for making the stand-up package of FIG. 7 using the reclosable closure mechanism of FIG. 6.

A process for manufacturing package 110 is shown schematically in FIG. 8. As illustrated in FIG. 8, the process line progresses from right to left so that the final package is at the lower left side of FIG. 8.

An extended length of reclosable closure mechanism 130 is joined with a polymeric film or other web (not shown) that will form side panels 112, 114 of the resulting package 110. The film web can be provided as two pieces, one for each of side panels 112, 114, or a single film web can be provided that is folded to provide both side panels 112, 114. The fold in the film web will be typically positioned at the resulting bottom 115 of package 110, although in some embodiments the fold may be positioned close to the mouth, where closure mechanism 130 is attached to the film web; such a construction will require some cutting, slitting, or other perforation of the film web in order to gain access to the interior of the resulting package.

Closure mechanism 130 may be interlocked or separated during the process of attaching closure mechanism 130 to the film web; that is, first inner closure profile 132' can be interlocked or engaged with second inner closure profile 142', or first closure profile 132 can be separated from second closure profile 142.

Closure mechanism 130 is attached to the film web at sealing flanges 136, 146. The film web can be attached to sealing flanges 136, 146 on either of the opposite sides of sealing flanges 136, that is, the inner side on which inner closure profiles 132', 142' reside, or the outer side on which outer closure profiles 132", 142" reside.

Although not shown, many suitable attachment mechanisms can be used to attach the extended length of closure mechanism 130 to the film web; for example, adhesive, solvent, ultrasonics, heat, pressure, or any combination, can be used to seal closure mechanism 130 to the film. In some embodiments, this attachment may be a continuous, permanent sealing or attachment; the attachment may be a "pre-seal", that is, is a spot seal or a weak seal; or, no attachment may be made between closure mechanism 130 and the film at this step of the process. As used herein, the terms "seal" and "pre-seal" mean that two pieces, such as extended closure mechanism 130 and film, are adhered to each other, at least with a temporary bond, preferably with a permanent bond. Various nip rolls, idler rolls, pull rolls, tensioners, bars, positioners, and the like can be used to drive, pull, guide position and otherwise manipulate closure mechanism 130 and the film in respect to one another.

The film web is folded, sealed, and otherwise processed to provide the various features of the package, features such as panels 112, 114, side panel 122 and the opposite side panel, and bottom 115 of package 110. Methods for folding, sealing, and otherwise forming packages having a surrounding wall such as package 110 are well known. Folding of gusset 125 is also well known.

To form package 110, a section of reclosable closure mechanism 130 is removed. Reclosable closure mechanism 130 is cut, slit, die punched, or processed in other suitable fashions to provide a removed section 150. The height of reclosable closure mechanism 130 is reduced in the area of removed section 150. Removed section 150 extends sufficiently deep so that inner closure profiles 132', 142' are removed from that length of closure mechanism 130 have removed section 150, but not so deep that outer closure profiles 132", 142" are disturbed. Removed section 150 has a width, which runs longitudinally along the extended length of closure mechanism 130 and which corresponds to the width of side panel 122. More specifically, removed section 150 has a length that corresponds to the sum of first portion 133*a* of a first package 110*a* and second portion 133*b* of an adjacent second package 110*b*. First package 110*a* and adjacent second package 110*b* will eventually be separated between first portion 133*a* of first package 110*a* and second portion 133*b* of adjacent second package 110*b*. The chain of connected packages is separated to form individual packages 110.

It is understood that the various steps in the above-described manufacturing method can be done in many sequences. For example, reclosable closure mechanism 130 can be provided with removed section 150 prior to attaching closure mechanism 130 to the film web. Alternately, closure mechanism 130 can be provided with removed section 150 after the film web has been folded and separated into individual packages 110. Other variations are foreseen.

Once separated into individual packages 110, removed section 150 is present at side panel 122 and the opposite side panel where gussets 125 are provided. The elimination of inner closure profile 132', 142' on the side panels allows gusset 125 to fold inward and interlock outer closure profiles 132", 142" present as gusset extension of closure mechanism 133.

The above specification and examples are believed to provide a complete description of the manufacture and use of particular embodiments of the invention. Many embodiments of the invention can be made without departing from the spirit and scope of the invention.

What is claimed:

1. A flexible package comprising:

(a) a first panel, an opposite second panel, a first side panel and an opposite second side panel together defining a package surrounding wall;

(b) the first side panel including a fold line dividing the first side panel into a first portion and a second portion; and tic second side panel including a fold line dividing the second side panel into a first portion and a second portion;

(c) a bottom attached to each of tile first panel, second panel, first side panel and second side panel, the bottom together with surrounding wall defining an interior for retaining an item therein;

(d) a mouth defined by surrounding wall opposite the bottom, the mouth providing access to the package interior; and (e) a reclosable closure mechanism surrounding the mouth, the reclosable closure mechanism comprising a first interlocking closure profile and a second interlocking closure profile; the reclosable closure mechanism comprising:

(i) a panel extension of closure mechanism comprising the first interlocking closure profile operably oriented on the first panel and the second interlocking closure profile operably oriented on the second panel, so that the first interlocking closure profile is engageable with the second interlocking closure profile;

(ii) a first gusset extension of closure mechanism comprising the first interlocking closure profile attached to the first portion of the first side panel, and the second interlocking closure profile attached to the second position of the first side panel, so that the first interlocking closure profile of the first portion is engageable with the second interlocking closure profile of the second portion; and (iii) a second gusset extension of closure mechanism comprising the first interlocking closure profile attached to the first portion of the second side panel, and the second interlocking closure profile attached to the second portion of the second side panel, so that the first interlocking closure profile of the first portion is engageable with the second interlocking closure profile of the second portion, wherein the first gusset extension of closure mechanism and the second gusset extension of closure mechanism are positioned closer to the package bottom than the panel extension of closure mechanism.

2. The package according to claim 1, wherein the first gusset extension of closure mechanism and the second gusset extension of closure mechanism are positioned parallel to the panel extension of closure mechanism.

3. The package according to claim 2, wherein the first gusset extension of closure mechanism and the second gusset extension of closure mechanism are displaced from the panel extension of closure profile about 5 to 20 mm.

4. The package according to claim 1, wherein the first gusset extension of closure mechanism and the second gusset extension of closure mechanism are angled about 20 to 80 degrees relative to the panel extension of closure mechanism.

5. The package according to claim 4, wherein the first gusset extension of closure mechanism and the second gusset extension of closure mechanism are angled about 50 to 70 degrees relative to the panel extension of closure mechanism.

6. The package according to claim 1, wherein the reclosable closure mechanism completely surrounds the mouth in a continuous and contiguous manner.

7. The package according to claim 1, further comprising:

(a) a second panel extension of closure mechanism comprising the first interlocking closure profile oriented on the first panel; and (b) a third panel extension of closure mechanism comprising the second interlocking closure profile oriented on the second panel.

8. A flexible package comprising:

(a) a first panel, an opposite second panel, a first side panel and an opposite second side panel, together defining a package surrounding wall;

(b) the first side panel including a fold line dividing the first side panel into a first portion and a second portion; and the second side panel including a fold line dividing the second side panel into a first portion and a second portion;

(c) a bottom attached to each of the first panel, second panel, first side panel and second side panel, the bottom together with the surrounding wall defining an interior for retaining an item therein;

(d) a mouth defined by the surrounding wall opposite the bottom, the mouth providing access to the package interior; and (e) a reclosable closure mechanisms surrounding the mouth, the reclosable closure mechanism comprising a first interlocking closure profile having a first mating member and a second interlocking closure profile having a second mating member; the reclosable closure mechanism comprising:

(i) a panel extension of closure mechanism comprising the first interlocking closure profile attached to the first panel and the second interlocking closure profile attached to the second panel, the first mating member and the second mating member each extending toward the package interior;

(ii) a first gusset extension of closure mechanism comprising the first interlocking closure profile attached to the first portion of the first side panel, and the second interlocking closure profile attached to the second portion of die first side panel, the first mating member and the second mating member each extending away from the package interior; and (iii) a second gusset extension of closure mechanism comprising the first interlocking closure profile attached to the first portion of the second side panel, and the second interlocking closure profile attached to the second portion of the second side panel, the first mating member and the second mating member each extending away from the package interior.

9. The package according to claim 8, wherein the first gusset extension of closure mechanism and the second gusset extension of closure mechanism are positioned closer to the package bottom than the panel extension of closure mechanism.

10. The package according to claim 9, wherein the first gusset extension of closure mechanism and die second gusset extension of closure mechanism are positioned parallel to the panel extension of closure mechanism.

11. The package according to claim 10, wherein the first gusset extension of closure mechanism and the second gusset extension of closure mechanism are displaced from the panel extension of closure mechanism about 5 to 20 mm.

12. The package according to claim 9, wherein the first gusset extension of closure mechanism and the second gusset extension of closure mechanism are angled 20 to 70 degrees relative to the panel extension of closure mechanism.

13. The package according to claim 8, wherein the reclosable closure mechanism completely surrounds the mouth in a continuous and contiguous manner.

14. A flexible package comprising:

(a) a first panel, an opposite second panel, a first side panel and an opposite second side panel, together defining a package surrounding wall;

(b) the first side panel including a fold line dividing the first side panel into a first portion and a second portion; and the second side panel including a fold line dividing the second side panel into a first portion and a second portion;

(c) a bottom attached to each of the first panel, second panel, first side panel and second side panel, the bottom together with surrounding wall defining an interior for retaining an item therein;

(d) a mouth defined by surrounding wall opposite the bottom, the mouth providing access to the package interior; and (e) a reclosable closure mechanism surrounding the mouth, the reclosable closure mechanism comprising a first interlocking closure profile and a second interlocking closure profile; the reclosable closure mechanism comprising:

(i) a first panel extension of closure mechanism comprising the first interlocking closure profile operably oriented on the first panel and the second interlocking closure profile operably oriented on the second panel, so that the first interlocking closure profile is engageable with the second interlocking closure profile;

(ii) a second panel extension of closure mechanism comprising the first interlocking closure profile oriented on the first panel;

(iii) a third panel extension of closure mechanism comprising the second interlocking closure profile oriented on the second panel, so that the second panel extension of closure mechanism is engageable with the third panel extension of closure mechanism;

(iv) a first gusset extension of closure mechanism comprising the first interlocking closure profile attached to the first portion of the first side panel, and the second interlocking closure profile attached to the second position of the first side panel, so that the first interlocking closure profile of the first portion is engageable with the second interlocking closure profile of the second portion; and (v) a second gusset extension of closure mechanism comprising the first interlocking closure profile attached to the first portion of the second side panel, and the second interlocking closure profile attached to the second portion of the second side panel, so that the first interlocking closure profile of the first portion is engageable with the second interlocking closure profile of the second portion.

15. The package according to claim 14, wherein the first gusset extension of closure mechanism and the second gusset extension of closure mechanism are positioned parallel to the first panel extension of closure mechanism.

16. The package according to claim 15, wherein the first gusset extension of closure mechanism and the second gusset extension of closure mechanism are positioned parallel to the first panel extension of closure mechanism, the second panel extension of closure mechanism, and the third panel extension of closure mechanism.

17. The package according to claim 14, wherein the first gusset extension of closure mechanism and the second gusset extension of closure mechanism are displaced from the first panel extension of closure profile about 5 to 20 mm.

18. The package according to claim 17, wherein the first gusset extension of closure mechanism and the second gusset extension of closure mechanism are displaced from the first panel extension of closure profile, the second panel extension of closure mechanism, and the third panel extension of closure mechanism about 5 to 20 mm.

19. The package according to claim 14, wherein the first gusset extension of closure mechanism and the second gusset extension of closure mechanism are angled about 20 to 80 degrees relative to the panel extension of closure mechanism.

20. The package according to claim 19, wherein the first gusset extension of closure mechanism and the second gusset extension of closure mechanism are angled about 50 to 70 degrees relative to the panel extension of closure mechanism.

* * * * *

UNITED STATES PATENT AND TRADEMARK OFFICE

CERTIFICATE OF CORRECTION

PATENT NO. : 6,533,456 B1
DATED : March 18, 2003
INVENTOR(S) : James E. Buchman

It is certified that error appears in the above-identified patent and that said Letters Patent is hereby corrected as shown below:

Column 8,
Line 54, insert -- the -- delete “tic”.
Line 57, insert -- the -- delete “tile”.

Column 9,
Line 12, insert -- portion -- delete “position”.

Column 10,
Line 6, insert -- mechanism -- delete “mechanisms”.
Line 38, insert -- the -- delete “die”.

Signed and Sealed this

Eleventh Day of October, 2005

JON W. DUDAS
*Director of the United States Patent and Trademark Office*